US007128695B2

(12) United States Patent
Panatta

(10) Patent No.: US 7,128,695 B2
(45) Date of Patent: Oct. 31, 2006

(54) GYMNASTIC APPARATUS FOR PECTORAL MUSCLES

(75) Inventor: Rodolfo Panatta, Apiro (IT)

(73) Assignee: Panatta Sport S.R.L., Apiro (IT)

( * ) Notice: Subject to any disclaimer, the term of this patent is extended or adjusted under 35 U.S.C. 154(b) by 547 days.

(21) Appl. No.: 10/458,236

(22) Filed: Jun. 10, 2003

(65) Prior Publication Data

US 2004/0005967 A1 Jan. 8, 2004

(30) Foreign Application Priority Data

Jun. 12, 2002 (IT) ..... BO2002A0370

(51) Int. Cl.
*A63B 21/062* (2006.01)

(52) U.S. Cl. ..... 482/100; 482/136

(58) Field of Classification Search ..... 482/100, 482/136, 139, 137, 138, 98–103
See application file for complete search history.

(56) References Cited

U.S. PATENT DOCUMENTS 3,708,166 A * 1/1973 Annas ..... 482/100
4,396,189 A * 8/1983 Jenkins ..... 482/71
4,482,152 A * 11/1984 Wolff ..... 482/113
4,757,992 A * 7/1988 Heitsch et al. ..... 482/136
4,844,456 A * 7/1989 Habing et al. ..... 482/100
4,949,951 A * 8/1990 Deola ..... 482/138
5,492,524 A * 2/1996 Marx ..... 482/112
5,514,060 A * 5/1996 Hu ..... 482/136
5,616,111 A * 4/1997 Randolph ..... 482/133
5,665,036 A * 9/1997 Hsieh ..... 482/100
5,967,954 A * 10/1999 Habing ..... 482/137
5,971,895 A * 10/1999 Habing ..... 482/100
6,004,247 A * 12/1999 Webber ..... 482/100
6,217,492 B1 * 4/2001 Huang ..... 482/100
6,234,941 B1 * 5/2001 Chu ..... 482/100
6,340,341 B1 * 1/2002 Purcell ..... 482/108
6,394,937 B1 * 5/2002 Voris ..... 482/139
6,579,213 B1 * 6/2003 Webber et al. ..... 482/100
6,689,023 B1 * 2/2004 Baumler ..... 482/100
6,746,385 B1 * 6/2004 Habing ..... 482/133
2002/0198088 A1 * 12/2002 Vuurmans et al. ..... 482/99

* cited by examiner

*Primary Examiner*—Henry Bennett
*Assistant Examiner*—Huong Pham
(74) *Attorney, Agent, or Firm*—Armstrong, Kratz, Quintos, Hanson & Brooks, LLP

(57) ABSTRACT

A gymnastic apparatus for pectoral muscles is equipped with two push arms (20) fitted to oscillate from initial positions to final positions and normally maintained in initial positions by means of a weight unit (2); a support element (32) for the user's forearm fitted to each push arm (20) to oscillate with respect to the push arm (20) at least during part of the movement of the push arm (20) from initial to final positions.

3 Claims, 3 Drawing Sheets

GYMNASTIC APPARATUS FOR PECTORAL MUSCLES

The present invention refers to a gymnastic apparatus for pectoral muscles. In particular, the invention refers to a gymnastic apparatus for pectoral muscles of the type comprising a support frame; two user-actuated push arms fitted to the frame to oscillate with respect to the frame around axes from initial to final positions; and weight unit used to maintain normally the push arms in initial positions.

The known gymnastic apparatuses of the aforementioned type do not allow for complete contraction, thus preventing ideal training of pectoral muscles, since the user's elbows are placed at a certain distance when the push arms are moved to final positions.

The purpose of the present invention is to obtain a gymnastic apparatus for pectoral muscles without the aforementioned drawbacks.

The gymnastic apparatus for pectoral muscles of the invention comprises a support frame; two user-operated actuators, each comprising a push arm fitted to the frame to oscillate around a first axis from initial to final position; and a weight unit used to normally maintain the push arms in initial positions; characterised in that each actuator also comprises a support element for the user's forearm fitted to the push arm to oscillate around a second axis during at least part of the movement of the push arm from initial to final positions.

The description of the invention continues with reference to the enclosed drawings of a possible, non-restrictive embodiment, whereby:

Figure 1:
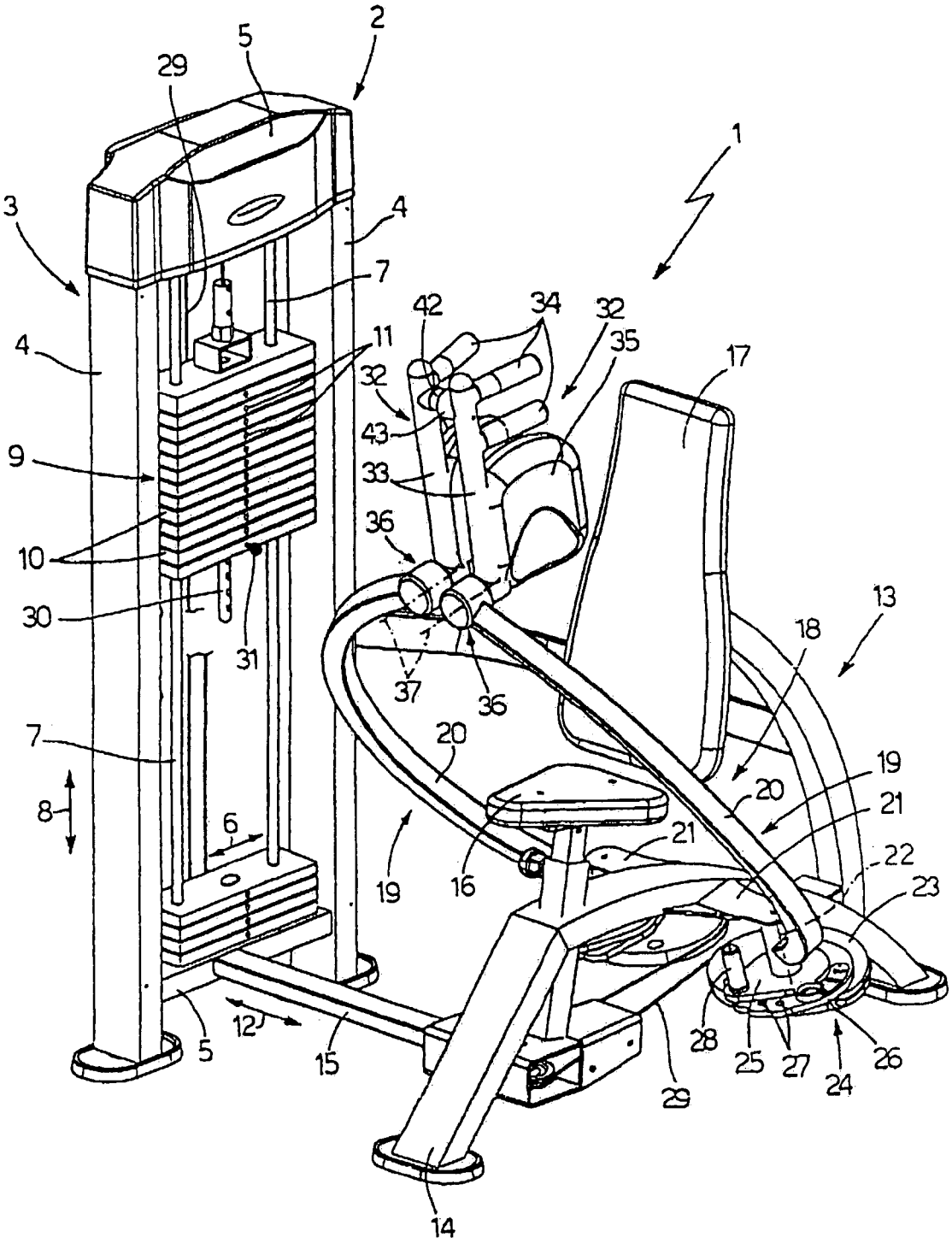
FIG. 1 is a diagrammatic perspective view of a preferred embodiment of the gymnastic apparatus of the invention.

With reference to FIG. 1, number 1 indicates a gymnastic apparatus for pectoral muscles.

The apparatus 1 is provided with a weight unit 2 of known type comprising a portal frame 3 composed of two parallel uprights 4; two crosspieces 5 extending between the uprights 4 in a basically horizontal direction 6; two guides 7 fitted between the crosspieces 5 parallel to a basically vertical direction 8 transversal to direction 6; and a stack 9 of basically rectangular plates 10, placed one on top of the other in direction 8, matched to guides 7 and provided with a hole 11 through the plate 10 in a basically orthogonal direction 12 to directions 6 and 8.

The apparatus 1 is also provided with a support device 13 for the user, which comprises a fixed frame 14 connected to one of the crosspieces 5 through a tubular profile 15 basically parallel-to direction 12; a seat 16 of known type with adjustable height and a backrest 17.

The weight unit 2 is actuated by the user by means of a lifting device 18 provided with two actuators 19, each of them comprising a push arm 20 that extends upwards and is fitted to an appendix 21 that laterally projects from the frame 14 to oscillate around an axis 22 with respect to the frame 14.

The arm 20 is also fitted to a cam 23 of known type and blocked to the cam 23 in angular position by means of a locking device 24 that allows for adjusting the initial position of the arm 20 with respect to the frame 14.

The device 24 comprises a flat plate 25 joined to the arm 20; a flat plate 26 fixed to the cam 23 and provided with multiple holes 27 through the plate 26 with arrangement around the axis 22; and a hooking pin 28 of known type brought by the plate 26 that moves from/to the hooking position, in which the pin 28 projects on the lower side of the plate 26 to engage one of the holes 27.

The cams 23 are connected by means of a system of traction cables 29 of known type to a rod 30, which is part of the device 18, fitted to the plates 10, and axially blocked to one of the plates 10 by means of a locking pin 31.

Figure 4:
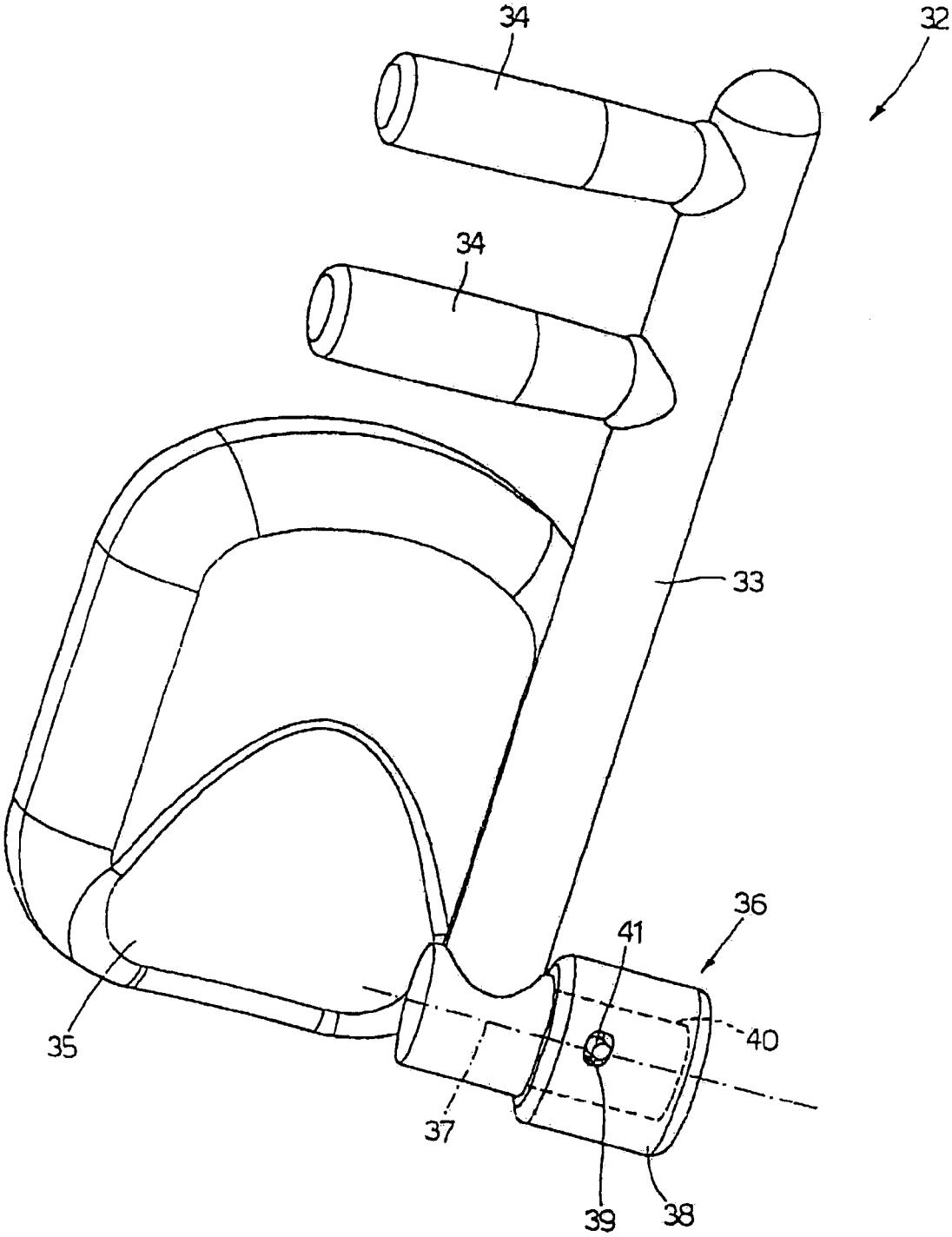
FIG. 4 is a diagrammatic perspective view of a detail of FIGS. 2 and 3.

With reference to FIG. 4, each actuator 19 is provided with a support element 32 for the user's forearm, which comprises a basically cylindrical rod 33, provided with two handles 34 and a padded section 35 and is fitted to the arm 20 through a coupling device 36 to oscillate around an axis 37 with respect to the arm 20.

The device 36 comprises a basically cylindrical hub 38, which is fixed at a free end of the arm 20 in coaxial position to axis 37, with a slot 39 in radial position through the hub 38 in basically coaxial position to the axis 37; and a pin 40, which projects from the rod 33 and engages the hub 38 with possibility of rotation and axial movement, with the pin 40 blocked in axial position through a pin 41 that extends in radial position outwards from the external surface of the pin 40 to engage the slot 39.

The free ends of the rods 33 are provided with a basically hemispherical projection 42 and a housing 43 that houses the projection 42 during use.

Figure 3:
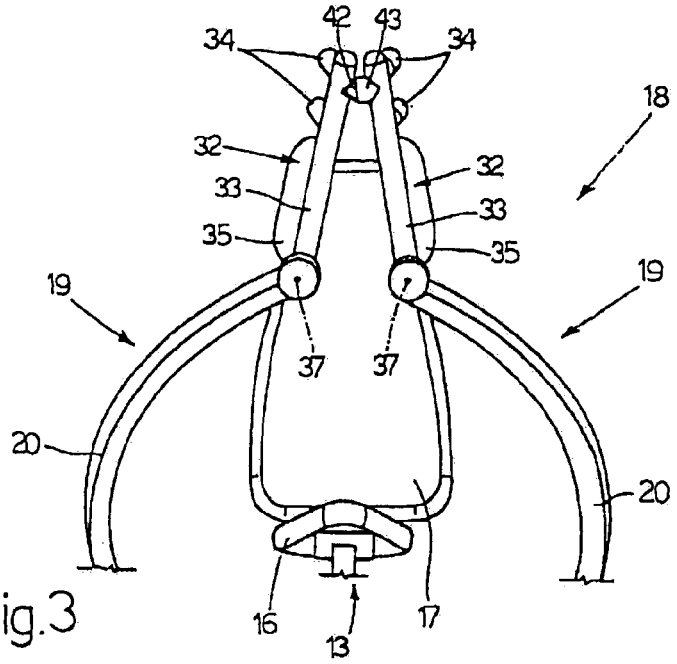
FIGS. 2 and 3 are front views of a detail of FIG. 1 shown in two different operating positions.
Figure 2:
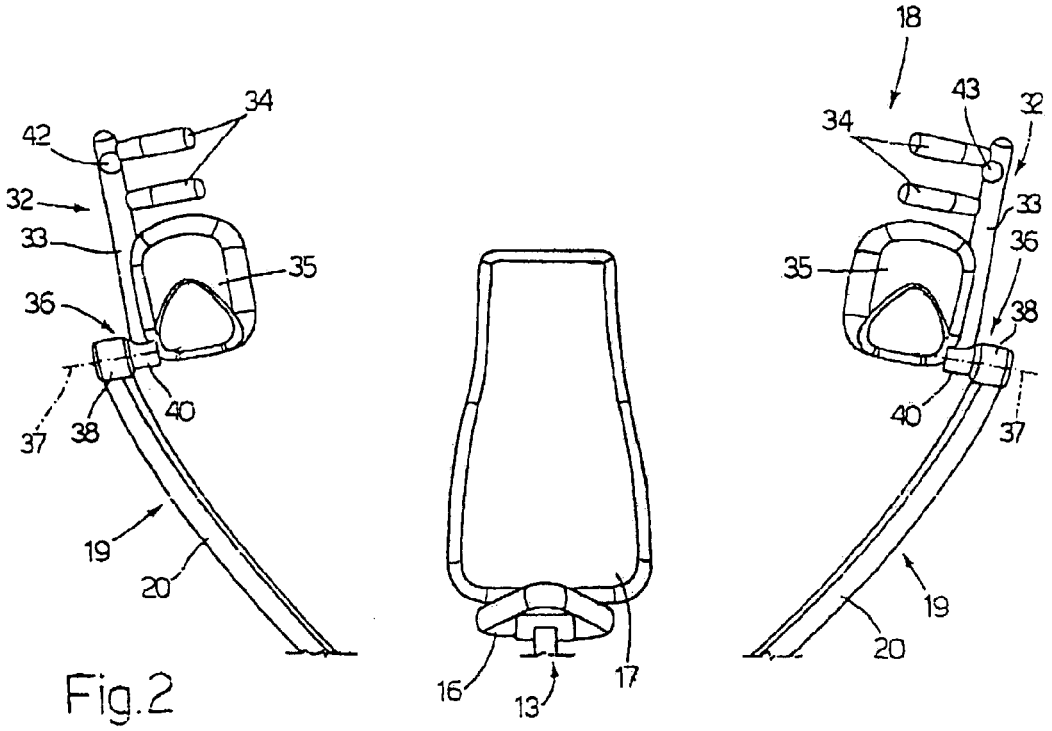

The user is seated on the apparatus 1, grabs the rods 33 and makes a first angular movement with the push arms 20 around the axes 22 from initial (FIG. 2) to intermediate positions (FIG. 3), in which the rods 33 are inclined, with the free ends touching each other, in order for the projection 42 to engage the housing 43.

The user completes the movement by pushing the rods 33 with his/her forearms in order to make a second angular movement with the push arms 20 around the axes 22 from intermediate (FIG. 3) to final positions (FIG. 1), in which the rods 33 are in basically vertical position with the hubs 38 in mutual contact.

According to an operating mode not shown in the enclosed figures, the user progressively moves the push arms 20 from initial positions directly to final positions, by combining the movements of the push arms 20 around the axes 22 and the movements of the rods 33 around the axes 37.

The invention claimed is:

1. Gymnastic apparatus for pectoral muscles, comprising a support frame (14);

two user-operated actuators (19), each having a push arm (20) fitted to the frame (14) to oscillate around a basically vertical first axis (22) from an initial to a final position;

a weight unit (2) used to normally maintain the push arms (20) in the initial positions;

wherein each actuator (19) also comprises a support element (32) adapted for the user's forearm fitted to the push arm (20) to oscillate around a second axis (37), the second axis being perpendicular to the aforesaid first axis (22) during at least part of the movement of the push arm (20) from the initial to the final positions; and wherein one of the support elements (32) has a projection (42) formed thereon and the other support element (32) has a housing (43) formed thereon wherein when the push arms (20) approach each other from the initial to the final position, the projection (42) and the housing (43) are engaged.

2. The gymnastic apparatus of claim 1, wherein the support element (32) is a rod (33) having at least one handle (34).

3. The gymnastic apparatus of claim 2, wherein said rod (33) has a padded section (35) formed thereon adapted for the user's forearm.

* * * * *